US008074735B2

(12) United States Patent
Aeberhard et al.

(10) Patent No.: US 8,074,735 B2
(45) Date of Patent: Dec. 13, 2011

(54) HAND-HELD POWER TOOL

(75) Inventors: Bruno Aeberhard, Studen (CH); Felix Buehlmann, Kriegstetten (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/280,026

(22) Filed: Nov. 16, 2005

(65) Prior Publication Data

US 2006/0118314 A1 Jun. 8, 2006

(30) Foreign Application Priority Data

Dec. 2, 2004 (DE) ..... 10 2004 058 175

(51) Int. Cl.
*B25B 21/02* (2006.01)

(52) U.S. Cl. ..... 173/216; 173/104; 173/217; 173/47; 173/48; 475/299; 475/266

(58) Field of Classification Search ..... 173/216, 173/104, 217, 47, 48; 475/299, 266
See application file for complete search history.

(56) References Cited

U.S. PATENT DOCUMENTS

| | | | | | |
|---|---|---|---|---|---|
| 3,178,956 | A | * | 4/1965 | Stanley | 74/375 |
| 3,673,363 | A | * | 6/1972 | Nakamura et al. | 200/557 |
| 3,835,715 | A | * | 9/1974 | Howell | 173/48 |
| 4,158,970 | A | * | 6/1979 | Laughon | 74/526 |
| 4,493,223 | A | * | 1/1985 | Kishi et al. | 74/371 |
| 4,540,318 | A | | 9/1985 | Hornung et al. | |
| 4,710,071 | A | * | 12/1987 | Koehler et al. | 408/133 |
| 4,791,833 | A | * | 12/1988 | Sakai et al. | 475/299 |
| 4,998,589 | A | * | 3/1991 | Wiesendanger | 173/170 |
| 5,842,527 | A | * | 12/1998 | Arakawa et al. | 173/48 |
| 5,967,934 | A | * | 10/1999 | Ishida et al. | 475/269 |
| 6,070,675 | A | * | 6/2000 | Mayer et al. | 173/48 |
| 6,086,502 | A | * | 7/2000 | Chung | 475/299 |
| 6,218,633 | B1 | | 4/2001 | Okumura et al. | |
| 6,296,427 | B1 | | 10/2001 | Potter et al. | |
| 6,401,837 | B1 | * | 6/2002 | Pan | 173/217 |
| 6,431,289 | B1 | * | 8/2002 | Potter et al. | 173/47 |
| 6,461,088 | B2 | * | 10/2002 | Potter et al. | 408/124 |
| 6,758,783 | B1 | * | 7/2004 | Chen | 475/266 |
| 6,824,491 | B2 | * | 11/2004 | Chen | 475/266 |
| 6,860,341 | B2 | * | 3/2005 | Spielmann et al. | 173/216 |
| 7,021,399 | B2 | * | 4/2006 | Driessen | 173/29 |
| 7,044,882 | B2 | * | 5/2006 | Eisenhardt | 475/298 |
| 7,066,691 | B2 | * | 6/2006 | Doyle et al. | 408/124 |
| 7,274,866 | B2 | | 9/2007 | Rudolf et al. | |
| 2006/0255752 | A1 | | 11/2006 | Chow et al. | |

FOREIGN PATENT DOCUMENTS

| | | |
|---|---|---|
| GB | 2 054 269 | 2/1981 |
| GB | 2 404 891 | 2/2005 |
| JP | 2001009746 | 1/2001 |
| WO | 2005/046916 | 5/2005 |

* cited by examiner

*Primary Examiner* — Rinaldi I. Rada
*Assistant Examiner* — Michelle Lopez
(74) *Attorney, Agent, or Firm* — Kenyon & Kenyon LLP

(57) ABSTRACT

A hand-held power tool has a handle, a least one two-speed transmission, at least one switch element for shifting the transmission between various gear ratios, wherein a distance between the switch element and a gripping region of the handle provided for placement of an operator's hand is less than or equal to a maximum finger extension range.

33 Claims, 3 Drawing Sheets

HAND-HELD POWER TOOL

CROSS-REFERENCE

The invention described and claimed hereinbelow is also described in DE 10 2004 058175.4, filed Dec. 2, 2004. This German Patent Application, whose subject matter is incorporated here by reference, provides the basis for a claim of priority of invention under 35 U.S.C. 119 (a)-(d).

BACKGROUND OF THE INVENTION

The present invention relates to a hand-held power tool, and a method for actuating a hand-held power tool.

It has already been proposed to equip a hand-held power tool with a handle and a two- or more speed transmission with a switch element. The switch element, as a slide switch or rotary knob, is located on the side or a top side—facing away from the handle—of a housing of the hand-held power tool, and is used to switch the transmission between various gear ratios.

SUMMARY OF THE INVENTION

It is therefore an object of the present invention to provide a hand-held power tool and a method of actuating the same, which are further improvements of the existing tools and methods.

The present invention is directed to a hand-held power tool with a handle, at least one two-speed transmission and at least one switch element for shifting the transmission between various gear ratios.

It is provided that a distance between the switch element and a gripping region of the handle provided for placement of the operator's hand is less than or equal to a maximum finger extension range. As a result, it is possible for an operator to shift the transmission with one hand without removing his hand from the handle, and by using the hand that grips the handle. The operator's second hand can remain free to do other tasks, e.g., to hold onto a ladder or a work piece. Moreover, it becomes possible to shift the transmission during operation of the hand-held power tool without the operator needing to remove his hand from the handle and risk injury. In all, a hand-held power tool with simplified handling is made possible.

The maximum finger extension range is defined as the maximum extension of a finger of the hand of an average operator. The extension does not exceed the average length of a human finger by more than 1-2 cm. In the individual case, the maximum finger extension range depends on a direction relative to the gripping region and which finger is used. Typically, a maximum extension of a thumb above a gripping region of a vertically oriented handle is 5-8 cm. The limits of the gripping region are also determined by an average size of an operator's hand that grips the handle.

The device according to the present invention is usable, in principle, with all types of hand-held power tools that include a shiftable transmission, particularly with screwdrivers and wrenches, drills, and rotary hammers. Locating the switch element within the maximum finger extension range makes it possible for the switch element to be actuated without the need for the operator to release the handle. Particularly advantageously, the switch element can be located in the region of a thumb of an operator's hand, and, in fact, above a position that the thumb assumes when the operator's hand is wrapped completely around the handle.

The switch element can be mechanically connected with the transmission or configured as an electrical or electronic switch that triggers an electromechanical gear shift.

In an embodiment of the present invention it is provided that the switch element is connected via a transmission mechanism with the transmission, by way of which an effect of actuating the switch element depends on a configuration of the transmission. Operator comfort can be increased as a result. Adaptation of the gear shift triggered by the switch element to the configuration of the transmission can take place automatically and need not be consciously taken into account by the operator.

It is furthermore provided that the transmission mechanism is designed to determine a gear shift from a sequence of gear shifts. The ability to operate the hand-held power tool in a convenient, sequential manner is made possible. Simply by repeatedly actuating the switch element, a large number of transmission configurations and gear ratios can be obtained without the need for the operator to release his hand from the handle.

Every one of the gear ratios can be reached easily from every other gear ratio when the transmission mechanism for cyclic shifting is provided between the gear ratios of the transmission. In this context, the term "provided" should be understood to also mean "designed" and "equipped".

A reliable transfer of a motion of the switch element to a change in configuration of the transmission can be achieved when the transmission mechanism includes, at the least, a control track for transferring a rotary motion of a shift drum to an axial displacement of a switch element of the transmission. The control track can be configured, e.g., as the groove that encircles the shift drum. As a result, a periodicity of the gear shifts can be realized using a simple design. If the shift drum has a two-component configuration and the control track is a connecting point between the two parts, the control drum can be advantageously manufactured in a casting procedure without a subsequent material-removing procedure and, in fact, it can be made cost-effectively out of plastic.

Convenient full-load shifting is attainable, in particular, when the transmission is designed as planetary gearing.

A convenient synchronization of the gear shift and a relative position of the shift element and the transmission that are flexibly adaptable to housing deformations can be realized when the switch element engages in the transmission via at least one shift spring. To compensate for a housing deformation, the transmission and the switch element can be composed of two different assemblies that are resiliently connected.

A hand-held power tool that can be operated in a particularly flexible manner with one hand can be obtained when the hand-held power tool includes an accumulator unit for supplying current to a drive motor, since the need to carry along a power supply cable can be eliminated.

A hand-held power tool that can be used universally by right-handed or left-handed operators, or with a single right or left hand can be obtained when the hand-held power tool includes at least two switch elements positioned symmetrical to the handle.

The present invention is also directed to a hand-held power tool with a transmission that includes a plurality of gear ratios, and a switch element, an actuation of the switch element triggering a change in the gear ratio.

It is provided that a position of the switch element is independent of a selected gear ratio of the transmission. As a result, a hand-held power tool that can be conveniently operated in a sequential manner can be obtained.

The present invention is also directed to a method for actuating a hand-held power tool with a transmission that includes a plurality of gear ratios, and a switch element, an actuation of the switch element triggering a change in the gear ratio.

It is provided that, when the switch element is actuated repeatedly, a predetermined sequence of gear shifts is carried out. As a result, the capability of operating the hand-held power tool in a convenient, sequential manner is made possible.

The novel features which are considered as characteristic for the present invention are set forth in particular in the appended claims. the invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
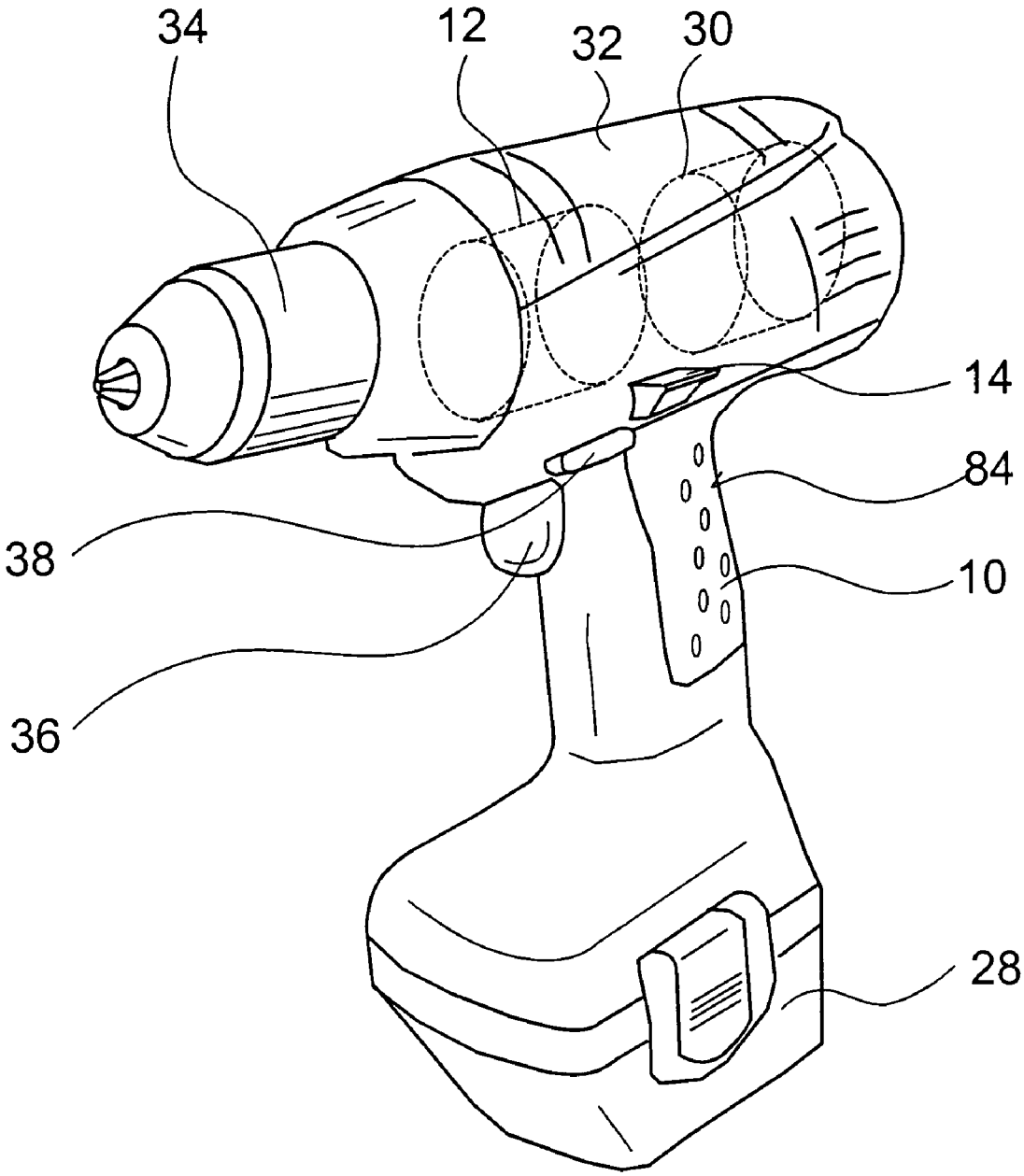
FIG. 1 Shows a hand-held power tool with a handle, a transmission, and a plurality of switch elements, FIG. 2 Shows a shifting device of the hand-held power tool in FIG. 1 with two switch elements, a transmission mechanism, and a switch member in an exploded view, FIG. 3 Shows a section of the hand-held power tool in FIG. 1 with a housing part removed, and FIG. 4 Shows a housing part of the hand-held power tool in FIGS. 1-3.

FIG. 1 shows a hand-held power tool designed as a cordless screwdriver with a not-explicitly-shown drive motor 30 that is supplied with energy by an accumulator unit 28 that is detachable from a housing 32 of the hand-held power tool, and which is designed as an electric motor. A torque generated by drive motor 30 can be stepped up or down by a transmission 12 designed as planetary gearing and transmitted to a tool chuck 34 in which various tools, screwdriver bits in particular, can be clamped.

The hand-held power tool has a longitudinal handle 10 that extends substantially radially relative to an axis of rotation of tool chuck 34, and out of which the body of the hand-held power tool extends in the axial direction, and on the second end of which accumulator unit 28 is attachable. A substantially cylindrical, ergonomically designed gripping region 84 of handle 10 extends between the body of the hand-held power tool and accumulator unit 28 that is provided for placement of an operator's hand. Gripping region 84 is equipped with a slip-proof rubber coating in a partial region of gripping region 84 provided for placement of an operator's hand.

Housing 32 has four switch elements 14, 14', 36, 38 passing through it, i.e., a switch element 36 designed as an on/off switch that is displaceable in the axial direction and is located in a region of handle 10 in which handle 10 transitions into the body of the hand-held power tool and in which an index finger of an operator's hand gripping handle 10 rests, so that an operator can activate and deactivate switch element 36 and, therefore, the hand-held power tool, via a simple motion of his index finger.

A further switch element 38 of the hand-held power tool is located above handle 10 in the body of the hand-held power tool and extends through the body in the manner of a chord. Switch element 38 engages in an electrical switch of the hand-held power tool and, by displacing switch element 38 in a direction extending perpendicularly to handle 10 and to the axis of rotation of the hand-held power tool, an operator can change the polarity of drive motor 30 and, as a result, change the direction of rotation of drive motor 30. As a result, the operator can select between directions of rotation for securing and releasing screws.

In addition, the hand-held power tool includes two switch elements 14, 14' located symmetrical to a plane extending from the axis of rotation and handle 10, on the body of the hand-held power tool, above handle 10, in a region that is accessible by a thumb of an operator's hand encircling handle 10, without the need for the operator to release handle 10 with his hand. A distance between switch elements 14, 14' and gripping region 84 of handle 10 is 5-7 cm long and is therefore within a maximum finger extension range. Switch element 14 is reachable by the thumb when the operator's hand is a right hand, and switch element 14' is reachable by the thumb when the operator's hand is a left hand. Switch elements 14, 14 each extend through a slot 82 in housing 32 and are displaceable on housing 32 in the circumferential direction relative to the axis of rotation.

Figure 2:
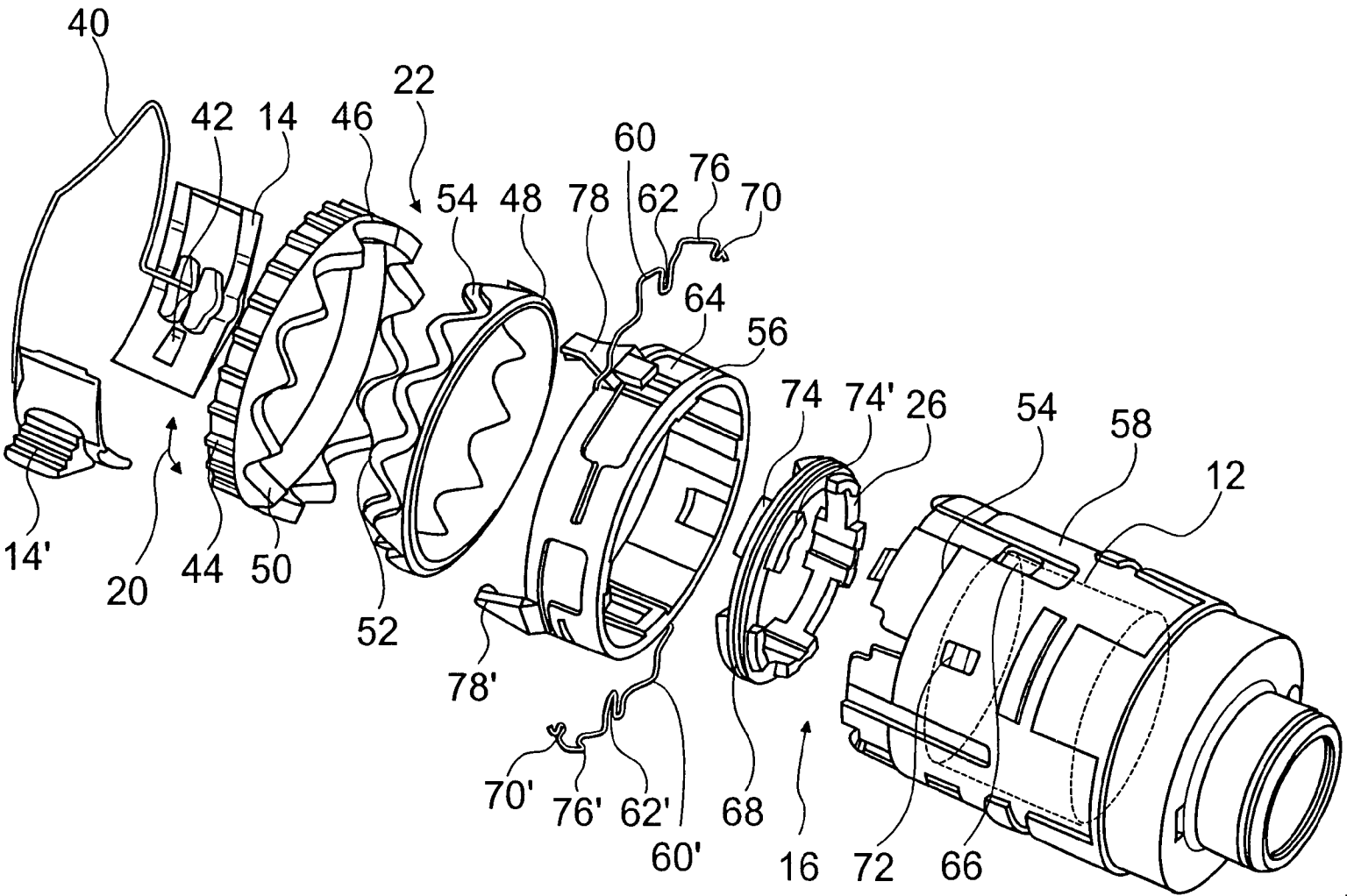

FIG. 2 shows switch elements 14, 14', a switch member 26 of transmission 12 configured as a shifting internal gear, the position of which is indicated in FIG. 2 by a dashed line, and a transmission mechanism 16 that connects switch elements 14, 14' with transmission 12. Transmission mechanism 16 transmits an effect—that depends on a configuration of transmission 12—of an actuation of one of the switch elements 14, 14' on transmission 12.

Switch elements 14, 14' are joined in the interior of housing 32 by a spring 40 that automatically resets switch elements 14, 14' into the upper end positions of slots 82 in housing 32. Switch elements 14, 14' each have sawtooth-shaped cams 42 extending into housing 32 that, in the installed state, engage in driving ribs 44 on a shift drum 22. Shift drum 22 is composed of two crown gears 46, 48, each of which is limited in the axial direction by matching, meandering and/or serpentine control curves 50, 52. Driving ribs 44 are integrally moulded on crown gear 46, while a shoulder 54 having a constant width is integrally moulded on crown gear 48 in the region of control curve 52 and extends circumferentially along control curve 52. When crown gears 46, 48 are slid together coaxially during assembly, shoulder 54 forms the base of a sinusoidally meandering control track 18 configured as a groove 54 encircling the periphery of shift drum 22.

Furthermore, transmission mechanism 16 includes an annular speed shifter 56 with three integrally moulded grippers 78, 78' that, in the installed state, engage in control track 18, so that a relative axial position between speed shifter 56 and shift drum 22 is forced by control track 18 as a function of the rotational position of speed shifter 56 relative to shift drum 22.

To assemble, speed shifter 56 and shift drum 22 with crown gears 46, 48 are slid onto a guide sleeve 58 in which transmission 12—which is not shown explicitly here—is located. Projections on an inner circumference of speed shifter 56 engage in recesses with axial extension on a jacket surface of guide sleeve 58 so that speed shifter 56 is supported such that it is non-rotatable and axially displaceable on guide sleeve 58.

Two shift springs 60, 60' designed as spring wires are engaged in speed shifter 56, each of which has a first, radially inwardly extending bend 62, 62'. Bends 62, 62' extend through recesses 64, 64' in speed shifter 56 and through recesses 66, 66' in guide sleeve 58, into a circumferential groove 68 on shift member 26 located in the interior of guide sleeve 58 and thereby connect shift member 26 with speed shifter 56 in an axially resilient and rotatable manner.

Furthermore, shift springs 60, 60' each have a second, radially inwardly extending curve 70, 70' that extends through a slot in speed shifter 56 and engages in a locking recess 72 in guide sleeve 58 and thereby bears against a base of locking recess 72 with a preload force. The base of locking recess 72 is convex in the axial direction, so that shift springs 60, 60' engage in the end positions of locking recess 72. An axial extension of locking recess 72 limits axial displacement of speed shifter 56 relative to guide sleeve 58. A preload of shift springs 60, 60' is produced by axial wave windings 76.

If shift member 26 is located in an axial position assigned to a first end position of locking recess 72, claws 74 of shift member 26 engage with corresponding claws and establish a non-rotatable connection between shift member 26 and guide sleeve 58, and transmission 12 is shifted into a first gear ratio. If shift member 26 is located in an axial position assigned to a second end position of locking recess 72, claws 74' of shift member 26 engage with corresponding claws and establish a non-rotatable connection between shift member 26 and a planet-wheel carrier—not shown here—of transmission 12. Transmission 12 is then shifted into a second gear ratio. Displacement 24 of speed shifter 56 and/or shift member 26 therefore enables shifting of transmission 12 between two gear ratios under full load.

If an operator slides shift element 14 with a thumb of his hand in the direction of handle 10, a steep flank of cam 42 comes to bear against one of the driving ribs 44 of shift drum 22, and the operator produces a rotary motion 20 of shift drum 22. As a result, grippers 78, 78' are displaced in control track 18 from one extreme to the adjacent extreme, that is, from a maximum in terms of the axial position, to a minimum in terms of the axial position, or vice versa. Shift springs 60, 60' are displaced accordingly from a first end position of locking recess 72 into a second end position of locking recess 72, and transmission housing 12 is shifted from the first gear ratio to the second gear ratio, or vice versa. If the operator subsequently releases shift element 14, spring 40 returns shift element 14 to its home position, a flat side of cam 42 sliding over driving rib 44. The home position is independent of a configuration of transmission 12. Transmission mechanism 16 therefore transfers the rotary motion 20 of shift drum 22 to displacement of shift member 26.

By actuating shift element 14 once more, the operator can shift transmission 12 back to the original gear ratio, by way of which a sequential actuation of a hand-held power tool is realized by periodically switching between the two gear ratios.

Actuating shift element 14' has the same effect as actuating shift element 14, although the direction of rotary motion 20 is switched.

Figure 3:
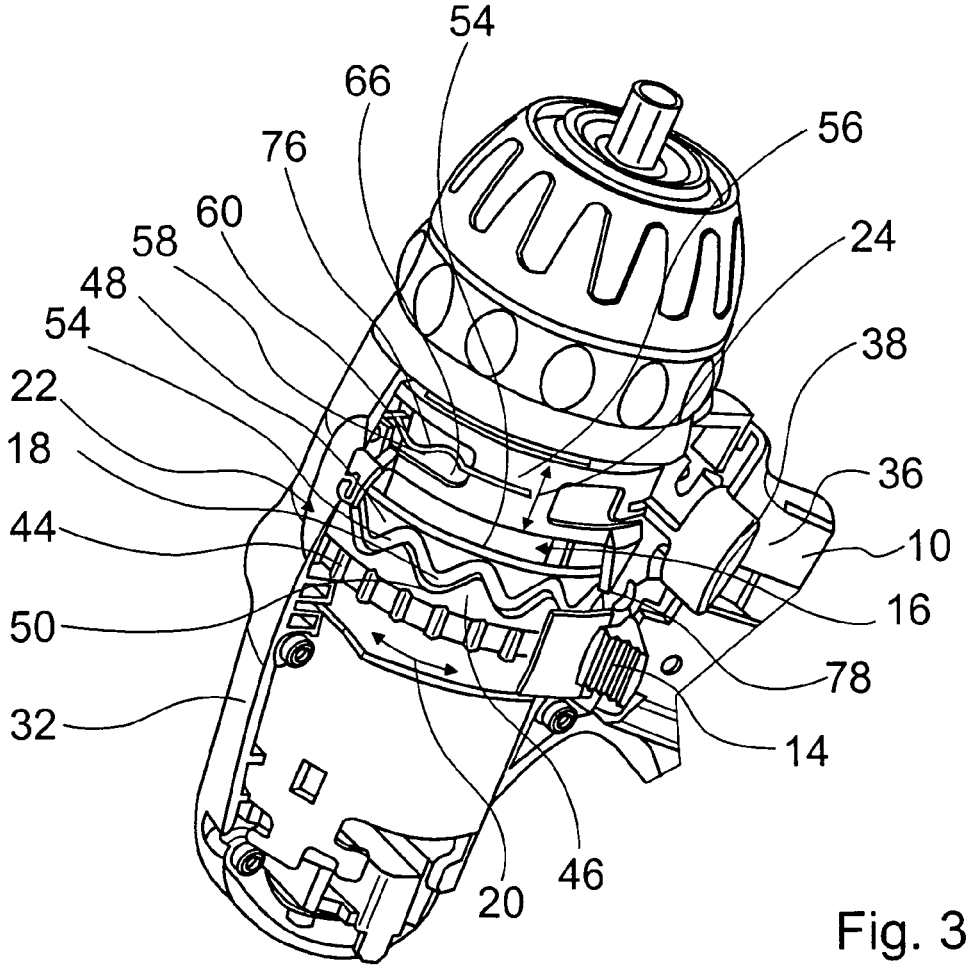

FIG. 3 shows the hand-held power tool in a partially-assembled state with engaged shift spring 60 and cam 42 of shift elements 14, 14' engaged with driving ribs 44 of shift drum 22.

Figure 4:
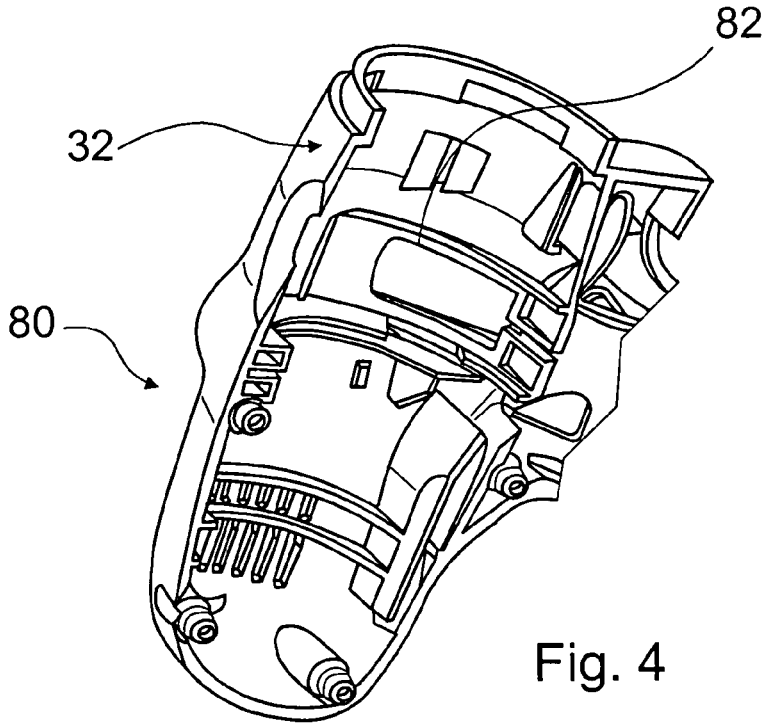

FIG. 4 shows a housing part 80 of the hand-held power tool with slot 82.

It will be understood that each of the elements described above, or two or more together, may also find a useful application in other types of constructions differing from the types described above.

While the invention has been illustrated and described as embodied in a hand-held power tool, it is not intended to be limited to the details shown, since various modifications and structural changes may be made without departing in any way from the spirit of the present invention.

Without further analysis reveal the foregoing will so fully revela the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims.

1. A hand-held power tool, comprising:

a housing;

a handle;

at least one two-speed transmission;

at least one switch element for shifting said transmission between various gear ratios; and a spring, wherein the switch element is displaceable from a home position and wherein the spring is configured to automatically return the switch element into the home position, wherein a distance between said at least one switch element and a gripping region of said handle provided for placement of an operator's hand is less than or equal to a maximum finger extension range, said housing having a housing portion arranged substantially perpendicularly to said handle, said at least two-speed transmission being located in said housing portion and said at least one switch element being located in a housing subportion, wherein said at least one switch element is operable so that an actuation of said switch element triggers a change in a gear ratio of said transmission, wherein a position of said at least one switch element relative to the housing is independent of a selected gear ratio in said transmission, and wherein said transmission mechanism includes at least one control track for transferring a rotary motion of a shift drum to an axial displacement of a switch member of said transmission.

2. The hand-held power tool as defined in claim 1, wherein a transmission mechanism is configured to determine a gear shift from a sequence of gear shifts.

3. The hand-held power tool as defined in claim 1, wherein said transmission mechanism is configured for cyclic shifting between the gear ratios of said transmission.

4. The hand-held power tool as defined in claim 1, further comprising:

at least one switch spring, by which said switch element engages in said transmission.

5. The hand-held power tool as defined in claim 1, further comprising:

a second switch element for shifting said transmission between various gear ratios.

6. The hand-held power tool as defined in claim 5, wherein said at least one switch element and said second switch element are joined.

7. The hand-held power tool as defined in claim 5, wherein said at least one switch element and said second switch element are joined by a spring.

8. The hand-held power tool as defined in claim 5, wherein a second distance between said second switch element and the gripping region of said handle provided for placement of an operator's hand is less than or equal to a maximum finger extension range.

9. The hand-held power tool as defined in claim 5, wherein said second switch element is located in said portion of said housing which is arranged substantially perpendicular to said handle.

10. The hand-held power tool as defined in claim 5, wherein said switch element and said second switch element are positioned symmetrically with respect to each other on opposite sides of a plane extending from a tool axis of rotation and handle.

11. The hand-held power tool as defined in claim 5, wherein said second switch element is displaceable on said housing in a circumferential direction relative to said tool axis of rotation.

12. The hand-held power tool as defined in claim 11, wherein said at least one switch element is displaceable on said housing in a circumferential direction relative to said tool axis of rotation.

13. The hand-held power tool as defined in claim 12, wherein, in use, the at least one switch element and the second switch element are displaced opposite to one another along a circumferential direction.

14. The hand-held power tool as defined in claim 1, wherein said at least one switch element for shifting said two-speed transmission is located on a body of the hand-held power tool above said handle.

15. The hand-held power tool as defined in claim 1, wherein said at least one switch element for shifting said transmission is located above said handle in a region that is accessible by a thumb of an operator's hand encircling said handle.

16. The hand-held power tool as defined in claim 1, wherein with respect to a plane substantially perpendicular to the handle and containing a tool axis of rotation, said at least one switch element passes through a housing portion which is on a side of said plane containing the handle.

17. The hand-held power tool as defined in claim 1, wherein with respect to a plane substantially perpendicular to the handle and containing a tool axis of rotation, said tool further comprising a slot through which said at least one switch element extends, wherein said slot is substantially in a housing portion which is on a side of said plane containing the handle.

18. The hand-held power tool as defined in claim 1, wherein said at least one switch element is displaceable on said housing in a circumferential direction relative to a tool axis of rotation.

19. The hand-held power tool as defined in claim 1, further comprising:

a second switch element for shifting said transmission between various gear ratios, wherein the first switch element and the second switch element are joined by the spring.

20. The hand-held power tool as defined in claim 1, wherein the switch element is configured so that a rotation of said switch element in a circumferential direction triggers a change in a gear ratio of said transmission, and wherein successive actuating of the switch element repeatedly in the same direction carries out a sequence of gear shifts.

21. The hand-held power tool as defined in claim 1, wherein the control track has a meandering control curve, said control curve having adjacent axial minimum and maximum points for displacement of said switch member of the transmission.

22. The hand-held power tool as defined in claim 1, wherein the at least two-speed transmission is a multiple-speed transmission having a plurality of gear ratios, wherein the at least one switch element is operable so that an actuation of the at least one switch element triggers a change in a gear ratio of the multiple-speed transmission, and wherein a position of said switch element is independent of a selective gear ratio in the multiple-speed transmission.

23. A hand-held power tool, comprising:

a housing;

a handle;

at least one two-speed transmission;

at least one switch element for shifting said transmission between various gear ratios; and a spring, wherein the switch element is displaceable from a home position and wherein the spring is configured to automatically return the switch element into the home position;

wherein a distance between said at least one switch element and a gripping region of said handle provided for placement of an operator's hand is less than or equal to a maximum finger extension range, said housing having a housing portion arranged substantially perpendicularly to said handle, said at least two-speed transmission being located in said housing portion and said at least one switch element being located in a housing subportion, wherein said at least one switch element is operable so that an actuation of said switch element triggers a change in a gear ratio of said transmission, wherein a position of said at least one switch element relative to the housing is independent of a selected gear ratio in said transmission, wherein said transmission mechanism includes at least one control track for transferring a rotary motion of a shift drum to an axial displacement of a switch member of said transmission, and wherein said switch member of said transmission is an annular speed shifter with grippers which engages in the control track so that a relative axial position between said speed shifter and the speed drum is forced by the control track.

24. A hand-held power tool, comprising:

a housing;

a handle;

at least one two-speed transmission;

at least one switch element for shifting said transmission between various gear ratios; and a spring, wherein the switch element is displaceable from a home position and wherein the spring is configured to automatically return the switch element into the home position;

wherein a distance between said at least one switch element and a gripping region of said handle provided for placement of an operator's hand is less than or equal to a maximum finger extension range, said housing having a housing portion arranged substantially perpendicularly to said handle, said at least two-speed transmission being located in said housing portion and said at least one switch element being located in a housing subportion, wherein said at least one switch element is operable so that an actuation of said switch element triggers a change in a gear ratio of said transmission, wherein a position of said at least one switch element relative to the housing is independent of a selected gear ratio in said transmission, wherein said transmission mechanism includes at least one control track for transferring a rotary motion of a shift drum to an axial displacement of a switch member of said transmission, wherein the control track has a meandering control curve, said control curve having adjacent axial minimum and maximum points for displacement of said switch member of the transmission, and wherein said switch member of said transmission is an annular speed shifter with grippers which engages in the control track so that a relative axial position between the speed shifter and shift drum is forced by the control track and wherein a rotary motion of the shift drum displaces the speed shifter from axial minimum point to said axial maximum point and from the axial maximum point to said axial minimum point.

25. A hand-held power tool, comprising:

a drive motor;

a two-speed transmission;

a housing including a body extending in an axial direction and including a handle extending substantially radially relative to an axis of rotation of a tool chuck, wherein the housing includes the drive motor and the two-speed transmission;

a first switch element, which is an on/off switch;

a second switch element for shifting the transmission between various gear ratios;

a spring, wherein the switch element is displaceable from a home position and wherein the spring is configured to automatically return the switch element into the home position, wherein a distance between the second switching element and a gripping region of the handle provided for placement of an operator's handle is less than or equal to a maximum finger extension range such that the first switch element and the second switch element are operable with one hand while operating the hand-power tool; and a transmission mechanism via which the second switch element is connected with the transmission and by which an effect of actuating the second switch element is a function of a configuration of the transmission;

wherein the transmission mechanism includes at least one control track for transferring a rotary motion of a shift drum to an axial displacement of a switch member of the transmission.

26. The hand-held power tool as defined in claim 25, wherein the transmission mechanism is configured to determine a gear shift from a sequence of gear shifts.

27. The hand-held power tool as defined in claim 25, wherein the transmission mechanism is configured for cyclically shifting between the gear ratios of the transmission.

28. The hand-held power tool as defined in claim 25, wherein the transmission is configured as a planetary gearing.

29. The hand-held power tool as defined in claim 25, further comprising:

a drive motor; and an accumulator unit for supplying power to the drive motor.

30. The hand-held power tool as defined in claim 25, wherein the transmission is a multiple-speed transmission having a plurality of gear ratios, wherein the second switch element is operable so that its actuation triggers a change in a gear ratio of the transmission, and wherein a position of the second switch element is independent of a selective gear ratio in the transmission.

31. The hand-held power tool as defined in claim 25, wherein the second switch element for shifting the two-speed transmission is located on a body of the hand-held power tool above the handle.

32. The hand-held power tool as defined in claim 25, wherein the second switch element for shifting the transmission is located above the handle in a region that is accessible by a thumb of an operator's hand encircling the handle.

33. A hand-held power tool, comprising:

a drive motor;

a two-speed transmission;

a housing including a body extending in an axial direction and including a handle extending substantially radially relative to an axis of rotation of a tool chuck, wherein the housing includes the drive motor and the two-speed transmission;

a first switch element, which is an on/off switch;

a second switch element for shifting the transmission between various gear ratios;

a spring, wherein the switch element is displaceable from a home position and wherein the spring is configured to automatically return the switch element into the home position, wherein a distance between the second switching element and a gripping region of the handle provided for placement of an operator's handle is less than or equal to a maximum finger extension range such that the first switch element and the second switch element are operable with one hand while operating the hand-power tool; and another switch element, the second switch element and the another switch element being positioned symmetrically with respect to the handle.

* * * * *